US009679694B2

(12) United States Patent
Kitami et al.

(10) Patent No.: US 9,679,694 B2
(45) Date of Patent: Jun. 13, 2017

(54) MANUFACTURING METHOD OF A REACTOR

(71) Applicants: Akio Kitami, Toyota (JP); Takashi Atsumi, Okazaki (JP); Nobuki Shinohara, Toyota (JP); Takeshi Okada, Chita-gun (JP)

(72) Inventors: Akio Kitami, Toyota (JP); Takashi Atsumi, Okazaki (JP); Nobuki Shinohara, Toyota (JP); Takeshi Okada, Chita-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 14/437,795

(22) PCT Filed: Dec. 17, 2013

(86) PCT No.: PCT/IB2013/002981
§ 371 (c)(1),
(2) Date: Apr. 22, 2015

(87) PCT Pub. No.: WO2014/096953
PCT Pub. Date: Jun. 26, 2014

(65) Prior Publication Data

US 2015/0279550 A1 Oct. 1, 2015

(30) Foreign Application Priority Data

Dec. 21, 2012 (JP) ..... 2012-280068

(51) Int. Cl.
*H01F 7/06* (2006.01)
*H01F 27/32* (2006.01)
(Continued)

(52) U.S. Cl.
CPC ..... *H01F 27/325* (2013.01); *H01F 27/022* (2013.01); *H01F 27/24* (2013.01);
(Continued)

(58) Field of Classification Search
CPC ..... H01F 27/022; H01F 27/22; H01F 27/24; H01F 27/263; H01F 27/266;
(Continued)

(56) References Cited

U.S. PATENT DOCUMENTS 4,095,206 A * 6/1978 Hishiki ..... H01F 41/005 336/178
6,246,172 B1 * 6/2001 Bizen ..... H01F 41/0226 315/5.41
(Continued)

FOREIGN PATENT DOCUMENTS

CN 102365693 A 2/2012
JP H0727129 U 5/1995
(Continued)

*Primary Examiner* — Paul D Kim
(74) *Attorney, Agent, or Firm* — Oliff PLC

(57) ABSTRACT

A manufacturing method of a reactor includes: assembling an assembly constituted by a coil and a bobbin by inserting the bobbin, which includes a tube portion and a flange portion, through the coil so that a tip of the tube portion protrudes from the coil; forming a cavity by installing the assembly in a first die so that a portion of a coil lateral face comes into contact with a cavity face of the first die, and closing a second die so that the second die is opposed to the first die; and extending first press rods from a cavity face of the second die toward the bobbin in the cavity, and injecting a resin into the cavity while pressing both ends of the bobbin in an axial direction of the coil from an opposite side to the portion of the coil lateral face.

6 Claims, 8 Drawing Sheets

(51) Int. Cl.

| | |
|---|---|
| ***H01F 27/02*** | (2006.01) |
| ***H01F 27/26*** | (2006.01) |
| ***H01F 27/30*** | (2006.01) |
| ***H01F 27/24*** | (2006.01) |
| ***H01F 27/28*** | (2006.01) |
| ***H01F 41/00*** | (2006.01) |
| *H01F 27/22* | (2006.01) |
| *H01F 27/40* | (2006.01) |

(52) U.S. Cl.
CPC ..... *H01F 27/266* (2013.01); *H01F 27/2823* (2013.01); *H01F 27/30* (2013.01); *H01F 27/323* (2013.01); *H01F 41/005* (2013.01); *H01F 27/22* (2013.01); *H01F 2027/406* (2013.01); *Y10T 29/4902* (2015.01)

(58) Field of Classification Search
CPC ..... H01F 27/2823; H01F 27/2847; H01F 27/2852; H01F 27/29; H01F 27/323; H01F 27/325; H01F 41/00
See application file for complete search history.

(56) References Cited

U.S. PATENT DOCUMENTS

| | | | | |
|---|---|---|---|---|
| 6,600,402 | B1 * | 7/2003 | LaFleur | H01F 27/22 336/198 |
| 6,771,157 | B2 * | 8/2004 | Nishikawa | H01F 3/14 336/178 |
| 8,497,756 | B2 * | 7/2013 | Kiyono | H01F 3/14 336/178 |
| 8,730,001 | B2 * | 5/2014 | Yoshikawa | H01F 27/306 336/178 |
| 8,922,319 | B2 * | 12/2014 | Yokota | H01F 27/327 336/178 |
| 9,449,751 | B2 * | 9/2016 | Miyamoto | H01F 27/022 |
| 2010/0176907 | A1 | 7/2010 | Hayasaki et al. | |
| 2012/0092120 | A1 | 4/2012 | Yoshikawa et al. | |
| 2012/0098631 | A1 * | 4/2012 | Ono | H01F 3/14 336/96 |
| 2012/0126928 | A1 | 5/2012 | Yoshikawa et al. | |
| 2013/0038415 | A1 | 2/2013 | Ooishi et al. | |
| 2013/0222100 | A1 | 8/2013 | Nomura et al. | |
| 2013/0314964 | A1 | 11/2013 | Yoshikawa | |

FOREIGN PATENT DOCUMENTS

| | | | |
|---|---|---|---|
| JP | 2010050334 | A | 3/2010 |
| JP | 2010165857 | A | 7/2010 |
| JP | 2010219251 | A | 9/2010 |
| JP | 2010238798 | A | 10/2010 |
| JP | 2011060915 | A | 3/2011 |
| JP | 2011071466 | A | 4/2011 |
| JP | 2011086657 | A | 4/2011 |
| JP | 2011243943 | A | 12/2011 |
| JP | 2012004300 | A | 1/2012 |
| JP | 2012114122 | A | 6/2012 |
| JP | 2012124401 | A | 6/2012 |
| JP | 2012191172 | A | 10/2012 |

* cited by examiner

MANUFACTURING METHOD OF A REACTOR

BACKGROUND OF THE INVENTION

1. Field of the Invention

The invention relates to a reactor and a manufacturing method of the same. Incidentally, the reactor is a passive element that utilizes a coil, and is also referred to as "an inductor".

2. Description of Related Art

A reactor may be employed in a circuit of a voltage converter or the like in a motor drive system of electric vehicles including hybrid vehicles. A large current is needed to drive a running motor. Therefore, a large current flows through the reactor as well, and the heat release value thereof is large. Thus, with a view to holding the heat release value small, a rectangular wire whose internal resistance is small is sometimes employed as a winding of a coil. In the case where the rectangular wire is employed, the rectangular wire is wound such that a wide face thereof is oriented in an axial direction of the coil. In other words, the rectangular wire is wound such that a narrow face thereof is oriented in a radial direction of the coil. Such a winding pattern is referred to as edgewise winding or vertical winding.

In order to further reduce the heat release value, it has been proposed to hold a radiator plate in contact with a lateral face of the coil, in addition to winding the rectangular wire edgewise (Japanese Patent Application Publication No. 2012-114122 (JP-2012-114122 A) and Japanese Patent Application Publication No. 2012-124401 (JP-2012-124401 A)).

Since the rectangular wire exhibits high rigidity, the radii of respective turns thereof may not be uniform. As a result, the outer position of the rectangular wire at each turn may be slightly displaced, and the area of contact with the radiator plate may be decreased. On the other hand, even if the coil is pressed from the other side of a coil lateral face intended to come into contact with the radiator plate, i.e., the contacting face, the contacting face (the coil lateral face that is intended to come into contact with the radiator plate) is not always sufficiently flattened due to low rigidity of the coil. Thus, in an art disclosed in Japanese Patent Application Publication No. 2012-114122 (JP-2012-114122 A), a plate is placed on the contacting face, and is pressed outward from inside the coil to flatten the contacting face. More details of the art disclosed in Japanese Patent Application Publication No. 2012-114122 (JP-2012-114122 A) are as follows.

In a reactor disclosed by Japanese Patent Application Publication No. 2012-114122 (JP-2012-114122 A), the rectangular wire is wound edgewise into a substantially rectangular shape, the entire coil is molded into a rectangular parallelepiped, and one lateral face thereof is brought into contact with the radiator plate. Hereinafter, among coil lateral faces, that which is intended to come into contact with the radiator plate will be referred to as the contacting face. Incidentally, a resinous insulator (bobbin) is arranged inside the coil. In order to uniformly flatten the contacting face, the bobbin is inserted through the coil, another plate is placed on the contacting face of the coil, and the bobbin is pressed from the other side of the contacting face at both ends of the coil in the axial direction thereof. Then, a tube portion of the bobbin is pressed outward (toward the contacting face side) from inside the coil, and the contacting face is uniformly flattened.

However, in the art disclosed in Japanese Patent Application Publication No. 2012-114122 (JP-2012-114122 A), the bobbin is divided into flange portions at both ends thereof (those portions which are opposed to the coil in the axial direction thereof respectively) and a window portion. Each of the flanges is provided with a protrusion portion that protrudes inward of the window portion and presses the window portion. In this manner, the art disclosed in Japanese Patent Application Publication No. 2012-114122 (JP-2012-114122 A) necessitates a complicated bobbin.

SUMMARY OF THE INVENTION

The invention relates to a reactor having a coil that is obtained by winding a rectangular wire edgewise, and provides an art of enhancing the cooling efficiency by uniformly flattening a lateral face (a contacting face) of the coil and ensuring good contact between the coil and a radiator plate (or a cooler).

A first aspect of the invention provides a manufacturing method of a reactor. The aforementioned manufacturing method includes: assembling an assembly that is constituted by a coil and a bobbin by inserting the bobbin, which includes a tube portion and a flange portion, through the coil so that a tip of the tube portion protrudes from the coil; forming a cavity by installing the coil assembly in a first die so that a portion of a coil lateral face comes into contact with a cavity face of the first die, and closing a second die so that the second die is opposed to the first die; and extending first press rods from a cavity face of the second die toward the bobbin in the cavity, and injecting a resin into the cavity while pressing both ends of the bobbin in an axial direction of the coil from an opposite side to the portion of the coil lateral face with respect to the tube portion. If the injected resin is solidified, the reactor in which the portion of the coil lateral face is exposed and the opposite portion is covered with the resin is completed. Incidentally, the resin is not required to cover the entire coil lateral face except the portion of the coil lateral face, and there may be an exposed portion in addition to the portion of the coil lateral face. Besides, with a view to ensuring a large area of contact with the radiator plate (a cooler), the coil may be substantially rectangularly wound and substantially have the shape of a rectangular parallelepiped as a whole. The entirety of one of four lateral faces (four faces other than two faces in the axial direction of the coil, among the six faces of the rectangular parallelepiped) may be exposed from the resin.

In the manufacturing method according to the first aspect of the invention, the bobbin having the tube portion that is provided with the flange is adopted. If both ends of the bobbin are pressed after the tube portion of the bobbin is passed through the coil, the tube portion presses the portion (the contacting face) of the coil lateral face against the cavity face from inside the coil. Since both the ends of the single bobbin are pressed, the contacting face can be stably pressed against the cavity face, and can be uniformly flattened.

The core may be inserted through the bobbin. In this case, the core protrudes from both the ends of the bobbin. In this structure, the reactor may be fixed to the cooler (or a case serving also as the radiator plate) on a lower face (a face on the same side as the contacting face) of the core. In such a case, heat is diffused also from the lower face of the core that is in contact with the cooler. The core lower face is, together with the contacting face, in contact with the cooler. Therefore, in order to ensure that the core lower face is in contact with the cooler with no gap therebetween, the positional accuracy of the core lower face relative to the contacting face is desired to be high. Accordingly, the first aspect of the invention may include pressing a core against the cavity face of the first die by extending a second press rod from the cavity face of the second die toward a portion of the core, which protrudes from both the ends of the bobbin in the axial direction of the coil, and pressing both ends of the core in the axial direction of the coil from the opposite side to the portion of the coil lateral face with respect to the tube portion, when injecting the resin into the cavity. The positional accuracy of the core lower face relative to the contacting face can be enhanced by pressing the contacting face of the coil and the core lower face against the die through the use of the different press rods.

The manufacturing method according to the first aspect of the invention may include: inserting a first core part and a second core part, which constitute the core, into the tube portion so as to be opposed to each other inside the bobbin; and filling a gap between the first core part and the second core part inside the bobbin with an adhesive. Furthermore, the resin may be injected into the cavity before the adhesive is solidified. Besides, the manufacturing method according to the first aspect of the invention may include providing an inner flange, which is configured to ensure the gap, on an inner face of the tube portion of the bobbin in a manner as to make a circuit of an inner periphery of the tube portion. In the case where the plurality of the core parts are united by the adhesive, if the adhesive is solidified before the core is pressed by the press rod, the relative position of the adjacent core parts may vary. As a result, when the press rod presses the core on both the sides of the bobbin, one of the core parts may not be in firm contact with the cavity face. Thus, if the core is pressed by the press rod before the adhesive is solidified, namely, while the respective core parts that protrude from both the ends of the bobbin can move independently of each other, the lower faces of the respective core parts are in firm contact with the cavity face.

A second aspect of the invention provides a reactor. The reactor includes a bobbin, a coil, and a core. The bobbin is constituted by at least a bobbin body and a flange part. The coil is constituted by a rectangular wire that is wound edgewise outside the bobbin. The core passes inside the bobbin. The bobbin body is constituted by a tube portion, a flange portion that is fixed to a first end of the tube portion, and a plate portion that extends from a second end of the tube portion in an axial direction of the tube portion. The flange part is mounted to the second end of the bobbin body. A coil lateral face includes a portion that is exposed from a resin, and a portion that is covered with the resin. When the aforementioned bobbin body is passed through the coil, the flange is exposed on one side in the axial direction of the coil, and the plate portion is exposed on the other side. The aforementioned press rod can press the flange on one side in the axial direction of the coil, and can press the plate portion on the other side. As described above, the rectangular wire may be substantially rectangularly wound so that the entire coil has the shape of a rectangular parallelepiped, and the entirety of one of the four lateral faces of the coil (the four faces except the two faces in the axial direction of the coil, among the six faces of the rectangular parallelepiped) may be exposed as the contacting face.

In the aforementioned reactor, the core may include a first core part and a second core part. Furthermore, the first core and the second core may be opposed to each other inside the tube portion of the bobbin. A gap between the first core part and the second core part inside the tube portion of the bobbin may be filled with an adhesive. Besides, an inner flange that is configured to ensure the gap may be provided on an inner face of the tube portion of the bobbin in a manner as to make a circuit of an inner periphery of the tube portion. In the foregoing configuration, the inner flange that is provided in a manner as to make a circuit of the inner periphery of the bobbin abuts on the first and second core parts, thus isolating the space filled with the adhesive from the cavity space. Therefore, when the resin is poured into the die, no resin enters the adhesive with which the inside of the frame-shaped flange is filled, and the adhesive and the resin do not mix with each other. Even if the resin is injected into the cavity before the adhesive is solidified, the adhesive is not diluted by the resin, and the core parts can be reliably glued to each other.

BRIEF DESCRIPTION OF THE DRAWINGS

Features, advantages, and technical and industrial significance of an exemplary embodiment of the invention will be described below with reference to the accompanying drawings, in which like numerals denote like elements, and wherein.

DETAILED DESCRIPTION OF EMBODIMENT

A method according to the embodiment of the invention is a manufacturing method of a reactor in which a portion of a lateral face of a coil, which is obtained by winding a rectangular wire edgewise into a substantially rectangular shape, is exposed and the other portion is covered with a resin. The portion of the coil lateral face is a face that is intended to come into contact with a radiator plate (or a cooler), and may be regarded as the aforementioned contacting face.

Figure 1:
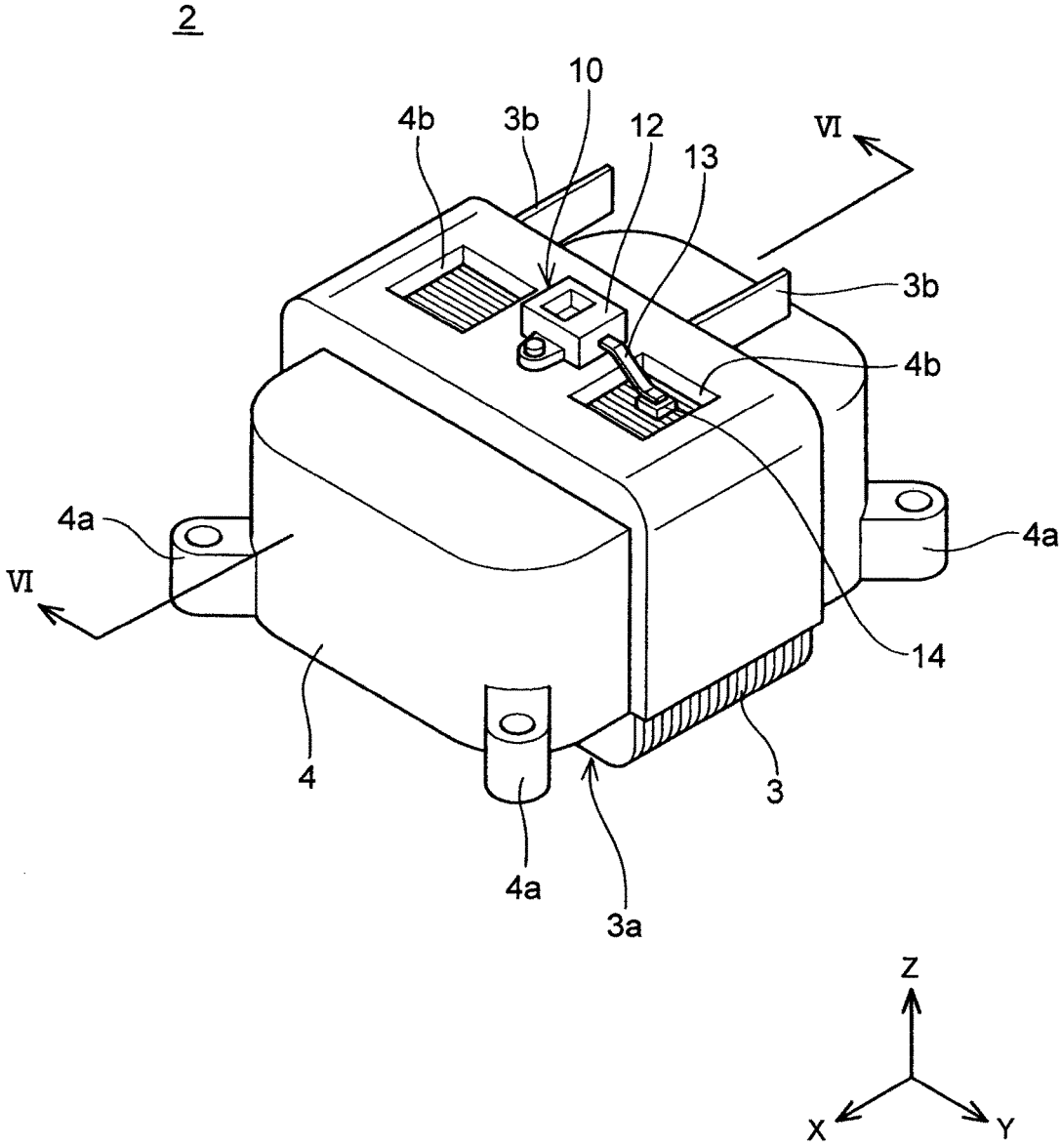
FIG. 1 is a perspective view of a reactor according to the embodiment of the invention.

A reactor 2 according to the embodiment of the invention will be described with reference to the drawings. FIG. 1 is a perspective view showing the reactor 2. The reactor 2 is employed for a voltage converter that steps up the voltage of a battery in, for example, a drive system of an electric vehicle. A running motor of the electric vehicle can output several dozens of kilowatts, and the current flowing from the battery is several dozens of amperes. Since such a large current flows through the reactor 2, a rectangular wire whose internal resistance is small is employed as a winding wire, and is used in combination with a cooler. Incidentally, for the convenience of explanation, the positive direction of a Z-axis of a coordinate system shown in the drawings will be referred to hereinafter as "up", and the negative direction of the Z-axis will be referred to hereinafter as "down".

A body of the reactor 2 is obtained by mounting a resinous bobbin to a core as a magnetic material, and winding a rectangular wire edgewise around the bobbin. In the reactor 2 according to the embodiment of the invention, a coil 3, a core 30 (which will be described later), and a bobbin 20 (which will be described later) are mostly covered with a resinous cover 4. An assembly of the core, the coil and the bobbin will be referred to hereinafter as a coil assembly 29.

Figure 2:
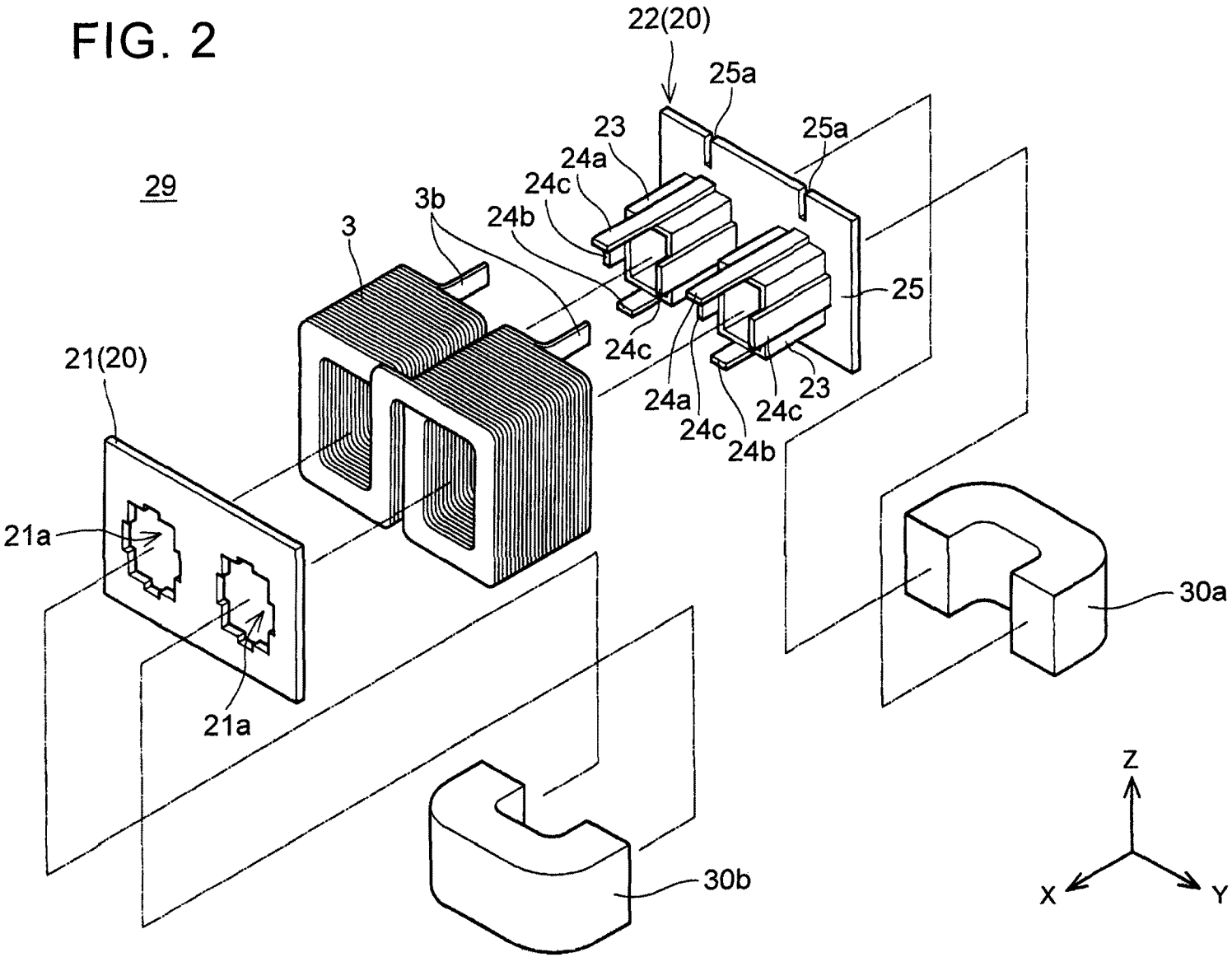
FIG. 2 is an exploded perspective view of a coil assembly according to the embodiment of the invention.

FIG. 2 is an exploded perspective view showing the coil assembly 29. The core 30 is divided into a pair of U-shaped core parts 30*a* and 30*b*. The U-shaped core parts 30*a* and 30*b* are opposed to each other to form an annular core. The pair of the U-shaped core parts 30*a* and 30*b* will be referred to comprehensively as a core 30. The bobbin 20 is constituted by a bobbin body 22 and a flange part 21. Both the bobbin body 22 and the flange part 21 are made of a resin. The bobbin body 22 is structured such that two tube portions 23 are coupled to each other by a flange portion 25 so as to become parallel to each other. The flange portion 25 is provided with slits 25*a* through which lead portions 3*b* of the coil 3 are passed. U-shaped leg portions of one of the core parts 30*a* are inserted through the tube portions 23 from the side of the flange portion 25 of the bobbin body 22. The coil 3, which is obtained by winding the rectangular wire edgewise, is arranged outside the two tube portions 23. As well shown in FIG. 2, the coil 3 is obtained by forming the single rectangular wire into two coils, and arranging the two coils parallel to each other such that the winding directions thereof become identical to each other. The rectangular wire exhibits high rigidity. Therefore, even the coil alone can maintain its shape. After the bobbin body 22 is inserted through the coil 3, the flange part 21 is mounted from the other side of the coil, and the core parts 30*a* and 30*b* are finally inserted through the tube portions 23 from ends of the bobbin 20 respectively, so that the coil assembly 29 is completed.

In the reactor 2 according to this embodiment of the invention, the shape of the bobbin 20 is characterized. The coil 3 is substantially rectangularly wound, and the tube portions 23 also have a substantially rectangular shape when viewed from the axial direction of the coil. Elongate plate portions 24*a*, 24*b* and 24*c* are provided on four lateral faces of each of the rectangular tube portions, respectively. The plate portions are extended from a tip of each of the tube portions 23 in the axial direction thereof. The plate portions 24*a* and 24*b* that are provided on upper and lower faces of each of the tube portions 23 are longer than the plate portions 24*c* that are provided on lateral faces of each of the tube portions 23 respectively.

Figure 3:
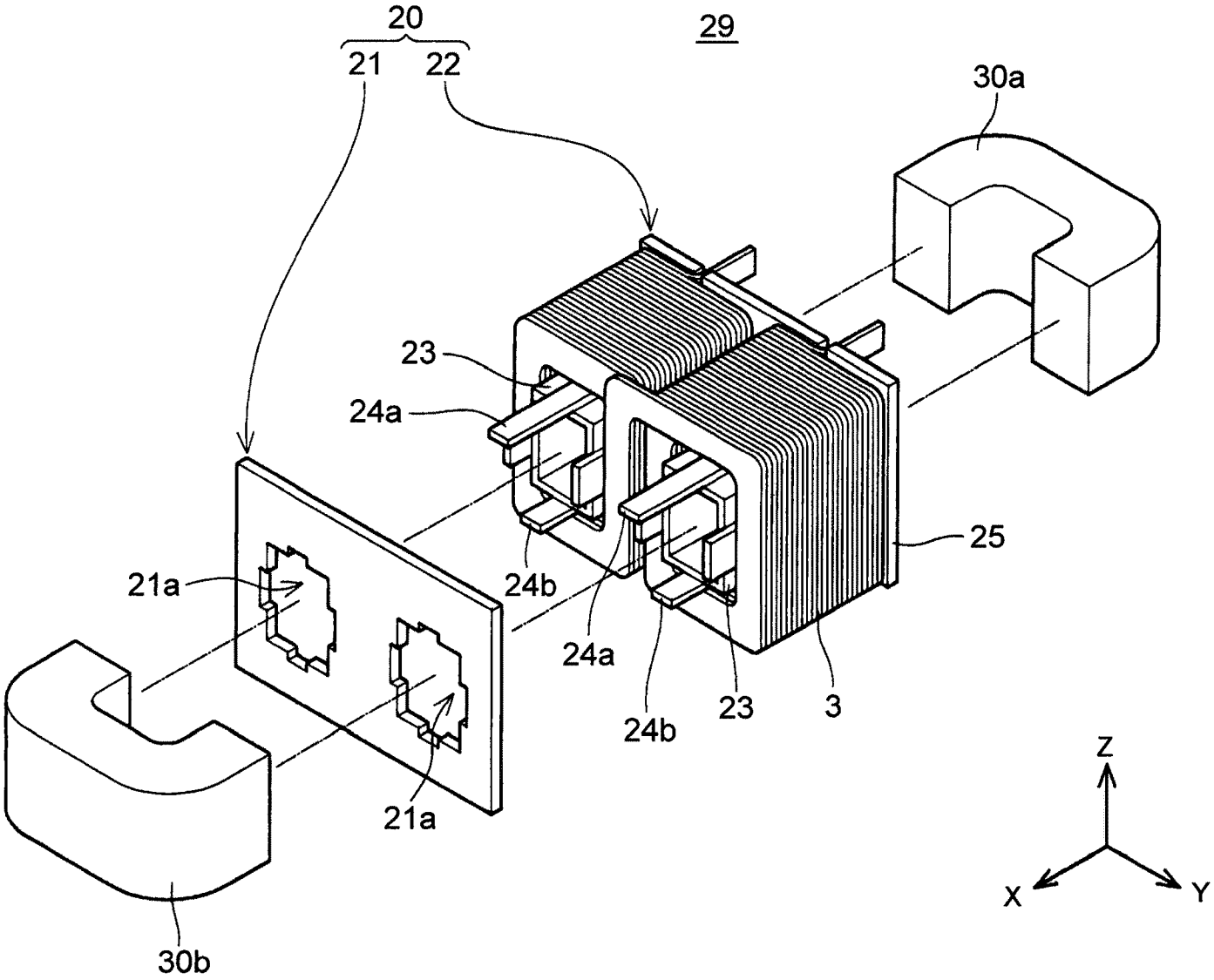
FIG. 3 is an exploded perspective view of the coil assembly according to the embodiment of the invention (in a state where a bobbin body is passed through a coil)
Figure 4:
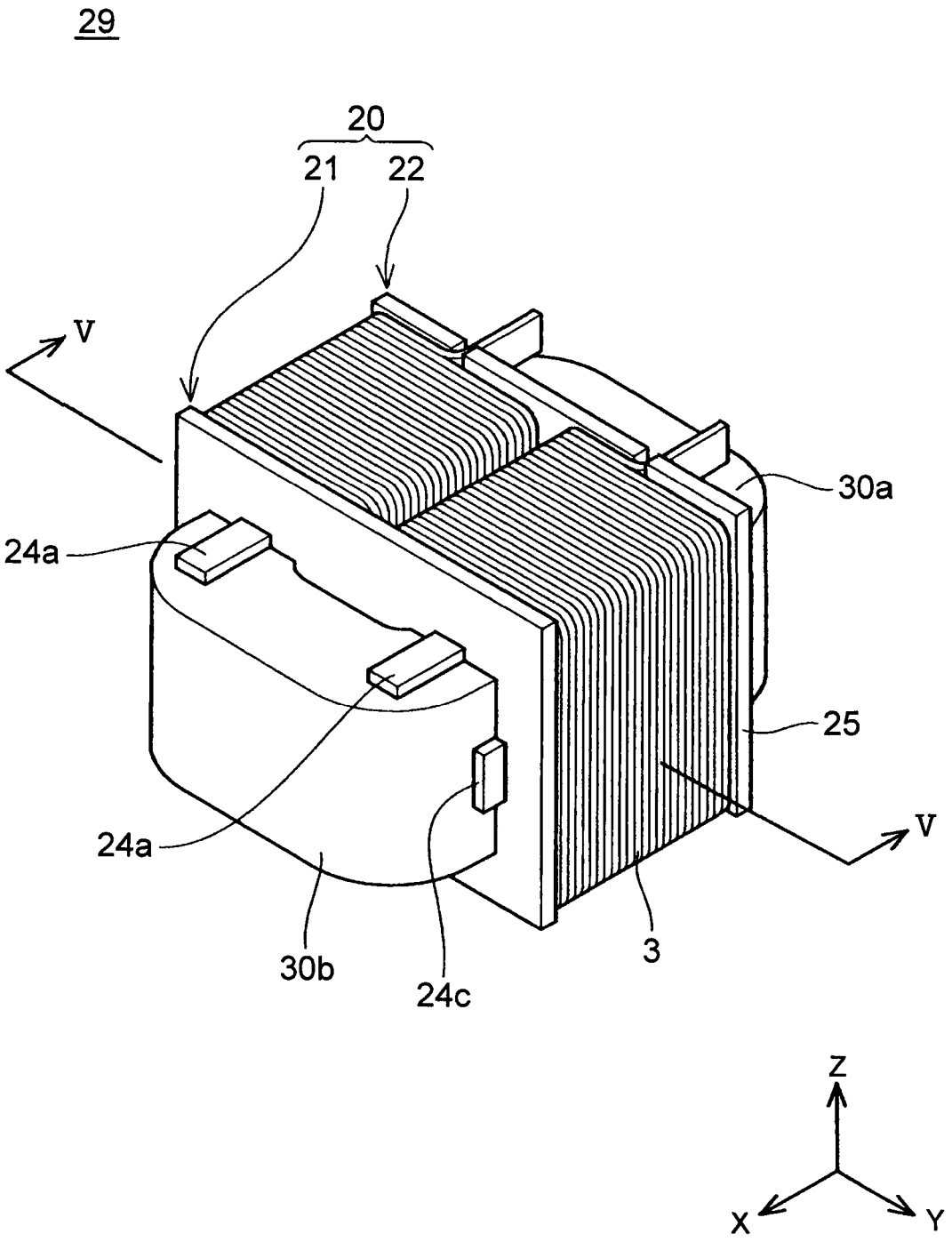
FIG. 4 is a complete perspective view of the coil assembly according to the embodiment of the invention.

FIG. 3 is a view showing a state where the bobbin body 22 is inserted through the coil 3, and FIG. 4 is a complete perspective view showing the coil assembly 29. As shown in FIG. 3, when the tube portions 23 are inserted through the coil 3, the plate portions 24*a*, 24*b* and 24*c* protrude from the other side of the coil 3. The flange part 21 as one component of the bobbin 20 is provided with fitting holes 21*a* that have the same outline as the tube portions 23 including the plate portions. When the fitting holes 21*a* are fitted to the tips of the tube portions 23 respectively, the bobbin having flanges on both sides of the coil is completed. When the core part 30*a* is inserted through the flange portion 25 of the bobbin body 22 and the other core part 30*b* is inserted from the other side of the flange part 21 with respect to the coil 3, the coil assembly 29 is completed. As well shown in FIG. 4, when the U-shaped core part 30*b* is inserted, the plate portions 24*a*, 24*b* and 24*c* of the bobbin body 22 surround the core part 30*b*, and the core part 30*b* is firmly fitted to the bobbin 20.

Figure 5:
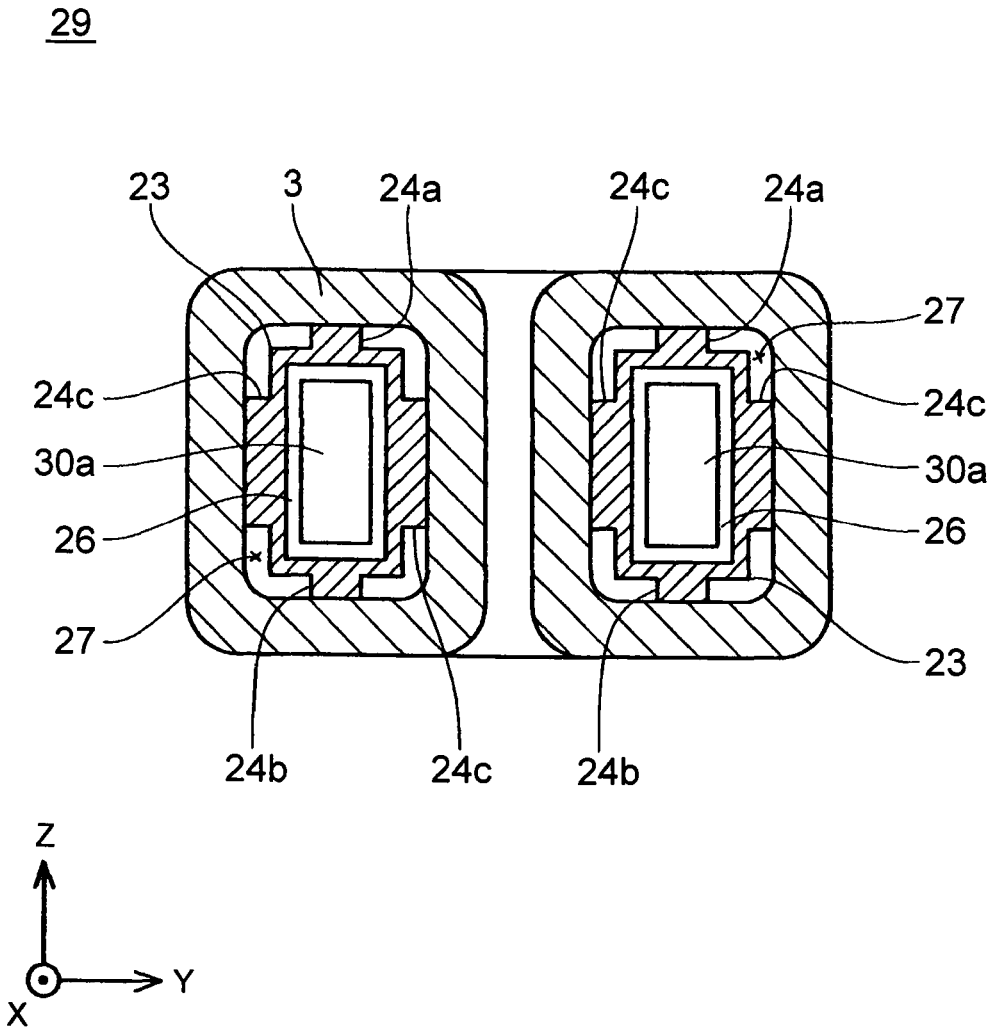
FIG. 5 is a cross-sectional view taken along an arrow line V-V of FIG. 4.

FIG. 5 is a cross-sectional view showing the coil assembly 29 taken along an arrow line V-V of FIG. 4. As well shown in FIG. 5, outer faces of the plate portions 24*a*, 24*b* and 24*c* that are provided on the four lateral faces of each of the tube portions 23 respectively are in contact with an inner lateral face of the coil 3 respectively, and the coil 3 is fitted to the bobbin body 22. Besides, at a corner portion of each of the tube portions 23, a void 27 is formed between an inner face of the coil 3 and an outer face of each of the tube portions 23. When the resin is injected, the molten resin flows into each of the lateral faces of each of the tube portions 23 through this void 27, the gap between each of the tube portions 23 and the coil 3 is filled with the resin, and the coil 3 and the bobbin 20 are firmly fixed to each other. Incidentally, although described again later, an inner flange 26 that ensures a gap between end faces of the two core parts 30*a* and 30*b* when the core parts 30*a* and 30*b* are opposed to each other is provided inside each of the tube portions 23, in such a manner as to make a circuit of an inner periphery of each of the tube portions 23. The inside of the inner flange 26 is filled with an adhesive, and the pair of the core parts 30*a* and 30*b* are fixed to each other inside each of the tube portions 23.

Referring again to FIG. 1, the description of the reactor 2 will be continued. The aforementioned coil assembly 29 is mostly covered with a resinous cover 4. The cover 4 is fabricated by injection-molding the resin around the coil assembly 29. The cover 4 aims at insulating the coil 3 from other devices, fixing the coil 3, the core 30 and the bobbin 20 to one another, and providing support members (bolt hole flanges 4*a*) for fixing the reactor 2 to a device (the cooler). Besides, windows 4*b* are provided through an upper face of the cover 4, and the coil 3 is exposed from the windows 4*b* as well. A temperature sensor module 10 is fixed to the cover 4 between the two windows 4*b*. The temperature sensor module 10 is constituted by a support portion 12, a leaf spring 13, and a sensor body 14, and the leaf spring 13 presses the sensor body 14 against the coil lateral face. Incidentally, lead portions of a rectangular wire that extends from the coil are denoted by a reference symbol 3*b* in FIG. 1.

Figure 6:
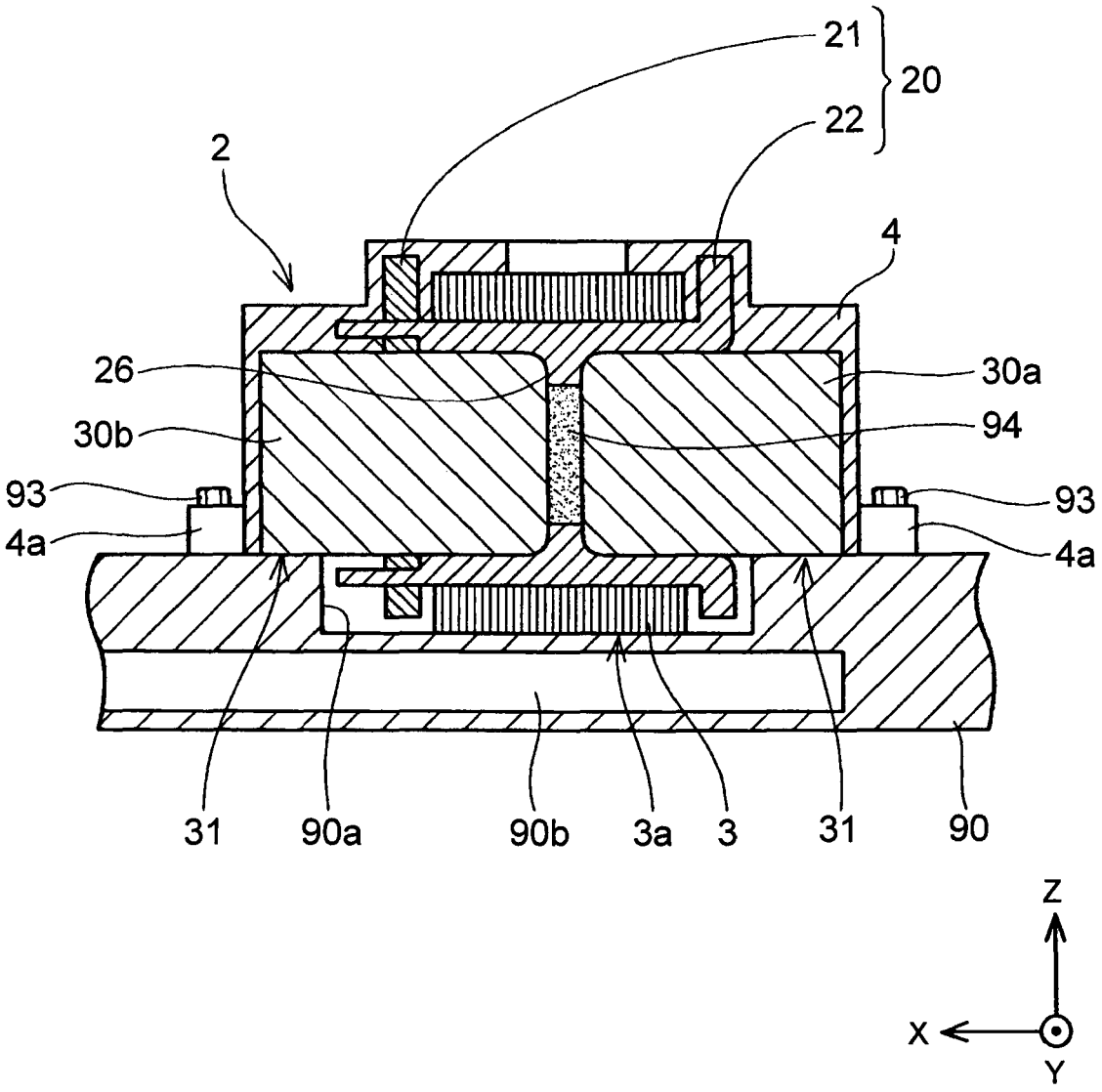
FIG. 6 is a cross-sectional view taken along an arrow line VI-VI of FIG. 1 (in a state where the reactor is mounted to a cooler)

The reactor 2 is used with the cooler abutting on a coil lower face 3*a* and a core lower face 31 (which will be described later). FIG. 6 is a cross-sectional view showing the reactor 2 in a state of being mounted to a cooler 90. The cross-section of the reactor shown in FIG. 6 is equivalent to a cross-section taken along an arrow line VI-VI of FIG. 1. The reactor 2 is fixed to an upper face of the cooler 90 by passing bolts 93 through the bolt hole flanges 4*a* that are provided through the cover 4. Lower faces of the bolt hole flanges 4*a* are flush with the lower face 31 of the core 30, and the lower face 31 of the core 30 is also in contact with the upper face of the cooler 90. A flow channel 90*b* is provided inside the cooler 90. A liquid cooling medium flows through this flow channel 90*b* to cool devices (including the reactor 2) that are in contact with the cooler 90. Accordingly, heat of the reactor 2 is absorbed by the cooler 90 through the lower face 31 of the core 30 that is in contact with the upper face of the cooler 90.

Besides, the cooler 90 is provided with a recess 90*a*. The reactor 2 is mounted such that the lower face 3*a* of the coil 3 is in contact with a bottom face of the recess 90*a*. A wall between the bottom face of the recess 90*a* and the flow channel 90*b* is thinner than a wall between the upper face of the cooler and the flow channel 90*b*, and heat of the coil is positively absorbed by the cooler 90 through the lower face 3*a* of the coil.

Structural features of the reactor 2 will be described. As shown in FIGS. 1 to 6, the bobbin 20 of the reactor 2 is constituted by two components, namely, the bobbin body 22 and the flange part 21. The bobbin body 22 is constituted by the tube portions 23 and the flange portion 25 that is provided at one end of each of the tube portions 23. Besides, the elongate plate portions 24*a*, 24*b* and 24*c* that extend from the tip of each of the tube portions 23 in the axial direction of each of the tube portions 23 are provided along the outer face of each of the tube portions 23, at the other end of each of the tube portions 23. The plate portions 24*a*, 24*b* and 24*c* are exposed from a coil end when each of the tube portions 23 is passed through the coil 3. The flange part 21 is mounted to the tip of each of the tube portions 23 through which the coil is inserted, and is opposed to both ends of the coil 3 together with the flange portion 25 of the bobbin body 22. The plate portions 24*a*, 24*b* and 24*c* that extend from the tip of each of the tube portions 23 protrude more outward in the axial direction of the coil than the flange part 21 when the flange part 21 is mounted. Besides, the coil 3 has a substantially rectangular cross-section. One lateral face (the lower face 3*a*) of the coil 3 is exposed, and the other portion of the coil 3 except the lower face 3*a* and the windows 4*b* is integrally covered with the resinous cover 4. The lower face 3*a* is a face that is in contact with the cooler 90, and may be regarded as the aforementioned contacting face.

The core 30, which is made of a magnetic material, is constituted by the pair of the U-shaped core parts 30*a* and 30*b*. The pair of the core parts 30*a* and 30*b* are inserted from both sides of each of the tube portions 23 respectively. The inner flange 26 that makes a circuit of the inner periphery is provided inside each of the tube portions 23. Due to this inner flange 26, a void is ensured between both ends of the pair of the U-shaped core parts 30*a* and 30*b*, inside each of the tube portions 23. The void is filled with an adhesive 94, and the pair of the core parts 30*a* and 30*b* are glued to each other. Incidentally, as shown in FIGS. 5 and 6, the inner flange 26 of each of the tube portions 23 makes a circuit of the inner periphery of each of the tube portions 23, and seals the void between the end faces of the pair of the U-shaped core parts 30*a* and 30*b*. Therefore, when the coil assembly 29 is installed in a die and the resin is injected to form the cover 4, the injected molten resin does not enter the void, and the resin can be injection-molded before the adhesive 94 is solidified. Although described later in detail, this is convenient for enhancing the positional accuracy of the lower face 31 of each of the pair of the U-shaped core parts 30*a* and 30*b*.

As well shown in FIG. 6, in the reactor 2, the lower face 31 of the core 30 and the lower face 3*a* of the coil 3 (one lateral face of a coil that has the shape of a rectangular parallelepiped as a whole) are in contact with the cooler 90. Therefore, the cooling efficiency increases as the positional accuracy of the plane of the lower face 31 of the core and the degree of flatness of the lower face 3*a* of the coil 3 increase. In particular, since the lower face 3*a* of the coil 3 is close to the flow channel 90*b*, the degree of flatness of the lower face 3*a* is an important factor for the cooling performance. On the other hand, as shown in FIG. 2, the coil 3 is obtained by winding the rectangular wire edgewise, and exhibits high rigidity. Therefore, it is difficult to accurately align the positions of the outer faces (especially the lower face 3*a*) of respective windings of the coil. A manufacturing method of the reactor 2 while enhancing the degree of flatness of the coil lower face 3*a* and the positional accuracy of the plane of the core lower face 31 will be described hereinafter.

An assembly process of the coil assembly will be described hereinafter. The aforementioned coil assembly 29 is assembled. As shown in FIG. 2, the rectangular wire is wound edgewise to prepare the coil 3 that has a substantially rectangular cross-section. Besides, the bobbin 20 and the pair of the U-shaped core parts 30*a* and 30*b* are prepared. The bobbin 20 is constituted by two components, namely, the bobbin body 22 and the flange part 21. The bobbin body 22 is provided, on one end side of each of the tube portions 23, with the flange portion 25 that couples the two tube portions 23 that are substantially rectangular in cross-section and are arranged parallel to each other. The plate portions 24*a*, 24*b* and 24*c*, which extend from the substantially rectangular four faces of each of the tube portions 23 respectively beyond the tip of each of the tube portions 23 in the axial direction of each of the tube portions 23, are provided at the other end of each of the tube portions 23. The flange part 21 is provided with the fitting holes 21*a* that are fitted to the tips of the tube portions 23 respectively. The bobbin body 22 is inserted through the coil 3 until the tips of the tube portions 23 protrude from the coil 3, and the flange part 21 is mounted from the tip sides of the tube portions 23. Finally, the U-shaped core parts 30*a* and 30*b* are inserted from both the sides of the bobbin 20 in the axial direction thereof. In this manner, the coil assembly 29 is assembled. Incidentally, a space surrounded by the inner flange 26 inside each of the tube portions 23 is filled with the adhesive 94, when the coil assembly 29 is assembled.

Figure 7:
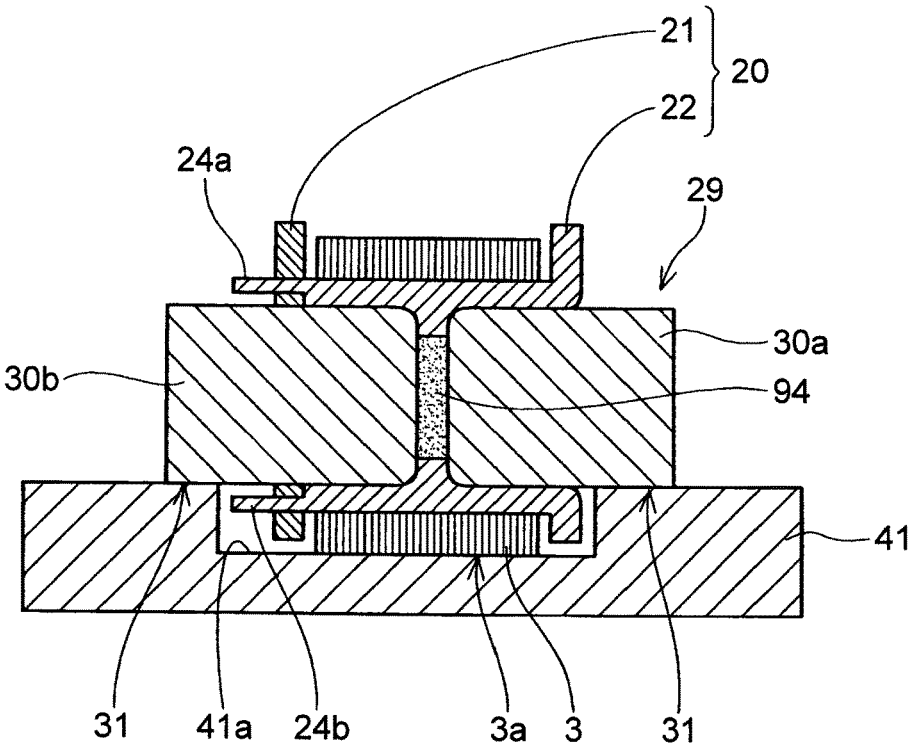
FIG. 7 is a view illustrating a manufacturing process according to the embodiment of the invention (a coil assembly installation process)
Figure 8:
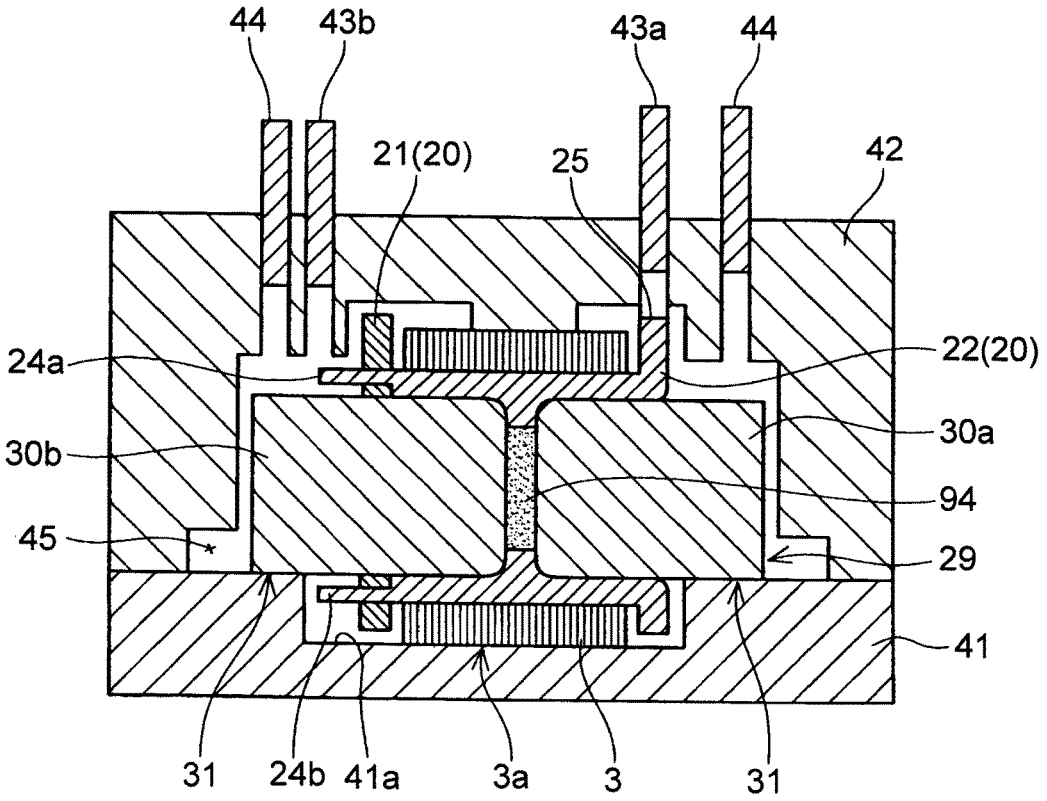
FIG. 8 is a view illustrating a manufacturing process according to the embodiment of the invention (a die closure process)

Next, in a die closure process, the coil assembly 29 is installed in a die, and the die is closed. The die is designed to injection-mold the cover 4. The die closure process will be described with reference to FIGS. 7 and 8. First of all, the coil assembly 29 is laid in a lower die 41 having a recess 41*a* that is identical to the previously described, recess 90*a* of the cooler 90 (FIG. 7). The lower face 3*a* of the coil is in contact with a bottom face of the recess 41*a* of the lower die 41. Besides, the lower face 31 of the core 30 is in contact with an upper face of the lower die 41. Incidentally, at this moment, the positional accuracy of the core lower face 31 is still not high, and the degree of flatness of the coil lower face 3*a* may not be high either. Then, an upper die 42 corresponding to the lower die 41 is arranged such that both the dies are opposed to each other, and the dies are closed (FIG. 8). A space that is created inside when the dies 41 and 42 are closed is a cavity 45.

The upper die 42 according to this embodiment of the invention includes four press rods 43*a*, 43*b* and 44. The press rods 43*a*, 43*b* and 44 can be vertically moved in a reciprocating manner from a cavity face of the upper die, by an actuator (not shown). At a stage where the dies are closed, the press rods 43*a*, 43*b* and 44 are located above, and are still out of contact with the coil assembly 29.

Figure 9:
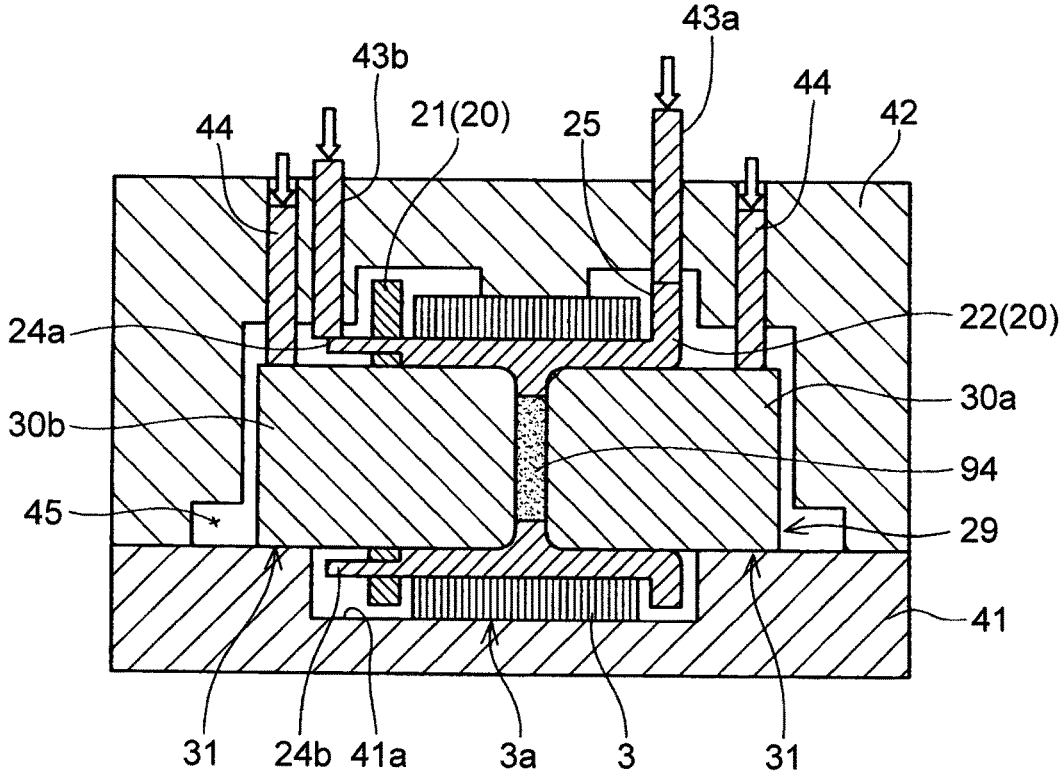
FIG. 9 is a view illustrating a manufacturing process according to the embodiment of the invention (a resin injection process)

After the dies are closed, in a resin injection process, the press rods 43*a*, 43*b* and 44 are lowered to press the coil assembly 29 from above, and press the lower face 3*a* of the coil and the core lower face 31 against the lower die 41 (FIG. 9). The two press rods 43*a* and 43*b* press the bobbin body 22 downward. One of the press rods 43*a* presses the flange portion 25, which is located on one end side of the coil 3, from above. The other press rod 43*b* presses the plate portion 24*a*, which is located on the other end side of the coil 3, from above. That is, the two press rods 43*a* and 43*b* press the bobbin body 22 downward on both the sides of the coil 3 in the axial direction thereof. By pressing the bobbin body 22 from above on both the sides of the coil, the tube portions 23 apply a load to the lower face 3*a* downward from inside the coil 3. When the lower face 3*a* is pressed from above the coil 3, the entire coil bends due to the elasticity thereof, and the lower face 3*a* may not always be uniformly flattened. However, the lower face 3*a* can be pressed downward from inside the coil 3 instead of being pressed from above the coil 3, by pressing the bobbin body 22 on both the sides of the coil in the axial direction thereof. Therefore, the lower face 3*a* is uniformly flattened regardless of the elasticity of the entire coil.

Besides, each of the other two press rods 44 presses a corresponding one of the pair of the U-shaped core parts 30*a* and 30*b* downward. This process is carried out before the adhesive 94 with which the space between the pair of the core parts 30*a* and 30*b* is filled is solidified. By pressing each of the core parts 30*a* and 30*b* downward during a period when the core parts 30*a* and 30*b* are not fixed to each other and can move independently of each other, the lower face 31 of each of the core parts 30*a* and 30*b* is individually pressed against the upper face of the lower die 41, and the positional accuracy (the positional accuracy in the height direction) of the lower face 31 is enhanced.

Figure 10:
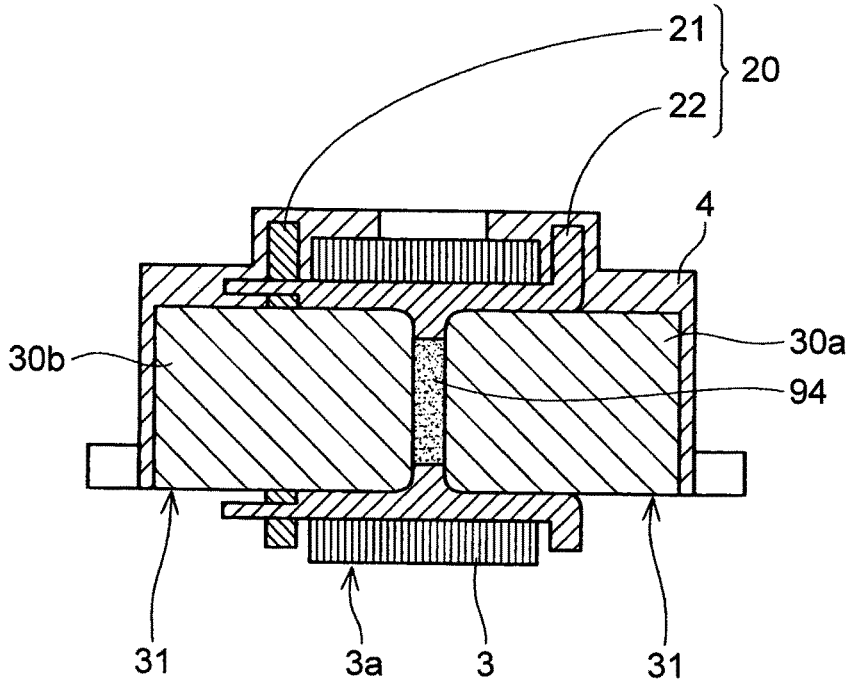
FIG. 10 is a view illustrating a manufacturing process according to the embodiment of the invention (a cross-sectional view of the completed reactor).

While the four press rods 43*a*, 43*b* and 44 press the bobbin body 22 and the core 30 downward as described above, the resin is injected into the cavity 45. When the resin is solidified, and the relative positional relationship among the coil 3, the core 30 and the bobbin 20 is fixed in a state where the coil lower face 3*a* and the core lower face 31 are pressed hard against the surface of the lower die 41 so that surface accuracy is enhanced. In this manner, the reactor 2 with the enhanced positional accuracy (the enhanced positional accuracy in the height direction) of the core lower face 31 and the enhanced degree of flatness of the coil lower face 3*a* is completed (FIG. 10). Incidentally, finally, the temperature sensor module 10 (see FIG. 1) is mounted to the reactor 2.

The features of the aforementioned art will be described. In the reactor 2, the bobbin 20 is constituted by at least two components, one of which includes a portion (the flange portion 25 and the plate portion 24*a*) that penetrates the coil 3 and protrudes on both the sides of the coil 3 in the axial direction thereof. The coil assembly 29 is installed in the dies, and that portion of the bobbin which protrudes on both the sides of the coil 3 in the axial direction thereof is pressed from above (through the use of the press rods 43*a* and 43*b*). The resin is injected in this state. By carrying out such a process, the coil lower face 3*a* is pressed against the lower die 41, the periphery of the coil 3 and the bobbin 20 is hardened by the resin with the degree of flatness of the lower face 3*a* enhanced, and the degree of flatness is maintained. Besides, by pressing each of the pair of the U-shaped core parts 30*a* and 30*b* from above through the use of the press rods 44 before the pair of the U-shaped core parts 30*a* and 30*b* are glued to each other by the adhesive 94, each of the core parts 30*a* and 30*b* is individually pressed against the surface of the lower die 41, and the positional accuracy of the lower face 31 is enhanced. In this manner, the reactor 2 with the enhanced degree of flatness of the lower face 3*a* of the coil and the enhanced positional accuracy of the lower face 31 of the core is obtained. A high cooling effect is obtained in the case where such a reactor is used such that the coil lower face 3*a* and the core lower face 31 are in contact with the cooler 90.

A point to remember about the art described in the embodiment of the invention will be described. In the embodiment of the invention, the art of enhancing the degree of flatness of the lower face 3*a* of the coil has been described. A face whose degree of flatness should be enhanced is not limited to the lower face. The degree of flatness of any face that is in contact with the cooler during use in a state of close contact with the cooler (such a face is referred to as a contacting face) may be enhanced. Such a face may be regarded as a face that constitutes a portion of the coil lateral face and is intended to come into contact with the cooler during using the reactor (the contacting face).

In the manufacturing method described in the embodiment of the invention, the bobbin 20 is pressed in the cavity, and the core 30 is pressed. The art disclosed by the present specification exerts a technical advantage simply by pressing the bobbin 20 in the cavity. That is, the degree of flatness of the coil lower face 3*a* can be enhanced by injecting the resin while pressing the bobbin 20.

In the manufacturing method described in the embodiment of the invention, when the reactor is taken out from the dies, there remain holes from which the press rods 43*a*, 43*b* and 44 are removed. The holes are ignored in the foregoing description. The holes may be left untouched, or another resin may be embedded in the holes.

The core of the reactor 2 is constituted by two parts, namely, the pair of the U-shaped core parts 30*a* and 30*b*. The core may be constituted by three or more parts. By the same token, the bobbin may be constituted by three or more parts. It is sufficient that one of the parts constituting the bobbin penetrate the coil in the axial direction thereof and have a portion that protrudes from both the sides of the coil in the axial direction thereof. In the case of the embodiment of the invention, the flange portion 25 of the bobbin body 22 protrudes from one side of the coil, and the plate portion 24*a* protrudes from the other side of the coil. By adopting such a bobbin, the bobbin that penetrates the coil in the cavity of the dies can be easily pressed from both the sides of the coil in the axial direction thereof, and the degree of flatness of the coil lower face 3*a* can be easily enhanced.

Although the concrete examples of the invention have been described above in detail, these are nothing more than exemplifications, and do not limit the invention. The invention encompasses various modifications and alterations of the concrete examples exemplified above, or combinations of the concrete examples.

The invention claimed is:

1. A manufacturing method of a reactor, comprising:

assembling an assembly constituted by a coil and a bobbin which bobbin includes a tube portion and a flange portion, by inserting the bobbin, through the coil so that a tip of the tube portion protrudes from the coil;

forming a cavity by installing the assembly in a first die so that a portion of a coil lateral face comes into contact with a cavity face of the first die, and closing a second die so that the second die is opposed to the first die; and inserting first press rods into the cavity to reach the bobbin through a cavity face of the second die, and injecting a resin into the cavity while pressing, from an opposite side of the tube portion from the portion of the coil lateral face, both ends of the bobbin in an axial direction of the coil with the first press rods.

2. The manufacturing method according to claim 1, further comprising:

inserting second press rods into the cavity to reach a portion of a core through the cavity face of the second die, the portion of the core protruding from both the ends of the bobbin in the axial direction of the coil; and pressing both ends of the core in the axial direction of the coil from the opposite side against the cavity face of the first die with the second press rods while injecting the resin into the cavity.

3. The manufacturing method according to claim 2, wherein the first die is provided with a recess, and while injecting the resin into the cavity, the both ends of the core are pressed against the cavity face of the first die such that the portion of the coil lateral face is in contact with the recess and is exposed from a resinous cover formed by injecting the resin into the cavity.

4. The manufacturing method according to claim 2, further comprising:

inserting a first core part and a second core part into the tube portion so as to be opposed to each other inside the bobbin, the first core part and the second core part constituting the core; and filling a gap between the first core part and the second core part inside the bobbin with an adhesive, wherein the resin is injected into the cavity before the adhesive is solidified.

5. The manufacturing method according to claim 4, further comprising providing an inner flange on an inner face of the tube portion of the bobbin, the inner flange having a ring shape and being configured to ensure the gap.

6. The manufacturing method according to claim 1, further comprising:

fixing the flange portion to a first end of the tube portion;

providing the bobbin with a plate portion that extends from a second end of the tube portion in an axial direction of the tube portion, wherein the flange portion and the plate portion are pressed by the first press rods while the resin is injected into the cavity.

* * * * *